US007399210B2

(12) United States Patent
Yoshimasa

(10) Patent No.: US 7,399,210 B2
(45) Date of Patent: Jul. 15, 2008

(54) REVERSE OPERATION CONTROL FOR WATERCRAFT

(75) Inventor: Kinoshita Yoshimasa, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 173 days.

(21) Appl. No.: 10/876,283

(22) Filed: Jun. 24, 2004

(65) Prior Publication Data

US 2004/0266286 A1 Dec. 30, 2004

(30) Foreign Application Priority Data

Jun. 24, 2003 (JP) ..... 2003-180009

(51) Int. Cl.

| | |
|---|---|
| ***B63H 21/21*** | (2006.01) |
| ***B63H 21/22*** | (2006.01) |
| ***F02D 11/10*** | (2006.01) |
| ***F02D 29/00*** | (2006.01) |
| ***F02D 41/04*** | (2006.01) |
| ***F02D 43/00*** | (2006.01) |
| ***F02P 5/15*** | (2006.01) |
| *B63B 35/73* | (2006.01) |
| *B63H 11/08* | (2006.01) |

(52) U.S. Cl. ..... 440/1; 440/84; 440/87

(58) Field of Classification Search ..... 440/1, 440/84–87

See application file for complete search history.

(56) References Cited

U.S. PATENT DOCUMENTS

| | | | | |
|---|---|---|---|---|
| 4,817,466 | A * | 4/1989 | Kawamura et al. | 477/112 |
| 5,261,844 | A | 11/1993 | Shibata | |
| 5,314,362 | A | 5/1994 | Nagahora | |
| 5,494,464 | A | 2/1996 | Kobayashi et al. | |
| 5,545,064 | A | 8/1996 | Tsunekawa et al. | |
| 6,015,319 | A | 1/2000 | Tanaka | |
| 6,174,264 | B1 | 1/2001 | Hoshiba et al. | |
| 6,484,693 | B1 | 11/2002 | Kanno | |
| 6,676,462 | B2 | 1/2004 | Yanagihara | |

FOREIGN PATENT DOCUMENTS

| | | |
|---|---|---|
| JP | 55-117045 | 9/1980 |
| JP | 56-106044 | 8/1981 |
| JP | 57-129241 | 8/1982 |
| JP | 62-126222 | 6/1987 |
| JP | 04133894 A * | 5/1992 |
| JP | 09-079125 | 3/1997 |
| JP | 10-274082 | 10/1998 |

* cited by examiner

*Primary Examiner*—Ajay Vasudeva
(74) *Attorney, Agent, or Firm*—Knobbe, Martens, Olson & Bear, LLP

(57) ABSTRACT

A watercraft has an engine that is controlled to provide a slower operational watercraft speed during a reverse operation of the watercraft. The engine is controlled by detecting a reverse operation and an operator engine torque request. An operational characteristic of the engine (e.g., engine speed) is adjusted to decrease the engine output by a predetermined amount after it is determined that the watercraft is in reverse operation.

15 Claims, 7 Drawing Sheets

REVERSE OPERATION CONTROL FOR WATERCRAFT

PRIORITY INFORMATION

This application is based on and claims priority to Japanese Patent Application No. 2003-180009, filed Jun. 24, 2003, the entire contents of which is hereby expressly incorporated by reference.

BACKGROUND OF THE INVENTIONS

1. Field of the Inventions

The present application generally relates to an engine control arrangement for controlling a watercraft, and more particularly relates to an engine management system that limits engine performance in a reverse operational mode.

2. Description of the Related Art

Watercraft, including personal watercraft and jet boats, are often powered by an internal combustion engine having an output shaft arranged to drive a water propulsion device. Occasionally, reverse operation is performed where the watercraft is maneuvered differently and has a different feeling than when the watercraft is operated in the forward direction. In a reverse operating condition, a rider can accelerate in reverse at a rate higher than what may be comfortable for the rider or passengers on the watercraft.

Some watercraft today come equipped with two modes of operation: a learning mode and a normal mode. The learning mode limits the top speed of the watercraft to a relatively low top speed, whereas in normal mode the watercraft is capable of traveling at a higher top speed.

SUMMARY OF THE INVENTIONS

An aspect of the present invention involves a watercraft comprising a hull, a reverse propulsion device selectively operable by a rider of the watercraft to propel the watercraft in reverse, and an engine disposed within the hull. The watercraft also comprises an engine power output request device operable by the rider of the watercraft, and a control system. The control system includes a controller that is configured to determine whether the rider has operated the reverse propulsion device. When the watercraft is operated in reverse, the controller controls the power output of the engine such that the power output is less than that corresponding to a state of the power output request device. In some operational modes, the watercraft can accelerate in reverse at a rate less than that requested by the rider in order to improve passenger comfort.

In accordance with another aspect of the invention, a method of operating a watercraft, which has a reverse propulsion device and an engine power request device, is provided. The method involves determining whether the rider has operated the reverse propulsion device to propel the watercraft in reverse and controlling the power output of the engine. The controlled power output of the engine is less than that corresponding to a state of the engine power output request device when the watercraft is operated in reverse.

BRIEF DESCRIPTION OF THE DRAWINGS

These and other features, aspects and advantages of the present invention will now be described with reference to the drawings of a preferred embodiment which are intended to illustrate and not to limit the invention. The drawings comprise the following 8 figures.

DETAILED DESCRIPTION OF THE PREFERRED EMBODIMENT

Figure 1:
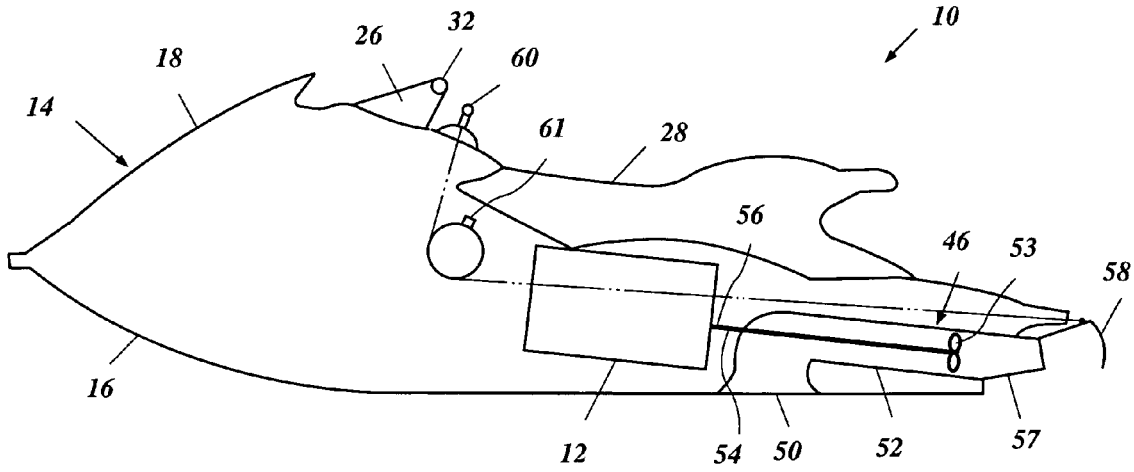
FIG. 1 is a side elevational view of a personal watercraft of the type powered by an engine controlled in accordance with a preferred embodiment of the present invention.
Figure 2:
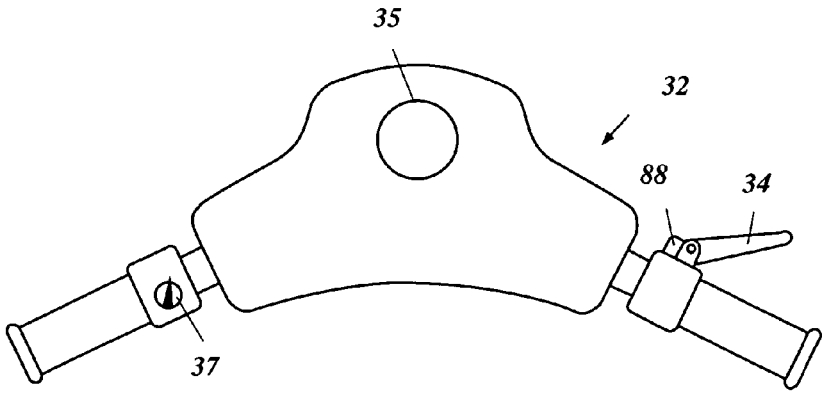
FIG. 2 is a top plan view of a handlebar steering assembly of the personal watercraft of FIG. 1 that includes an engine power switch, a throttle lever and a throttle lever position sensor.
Figure 3:
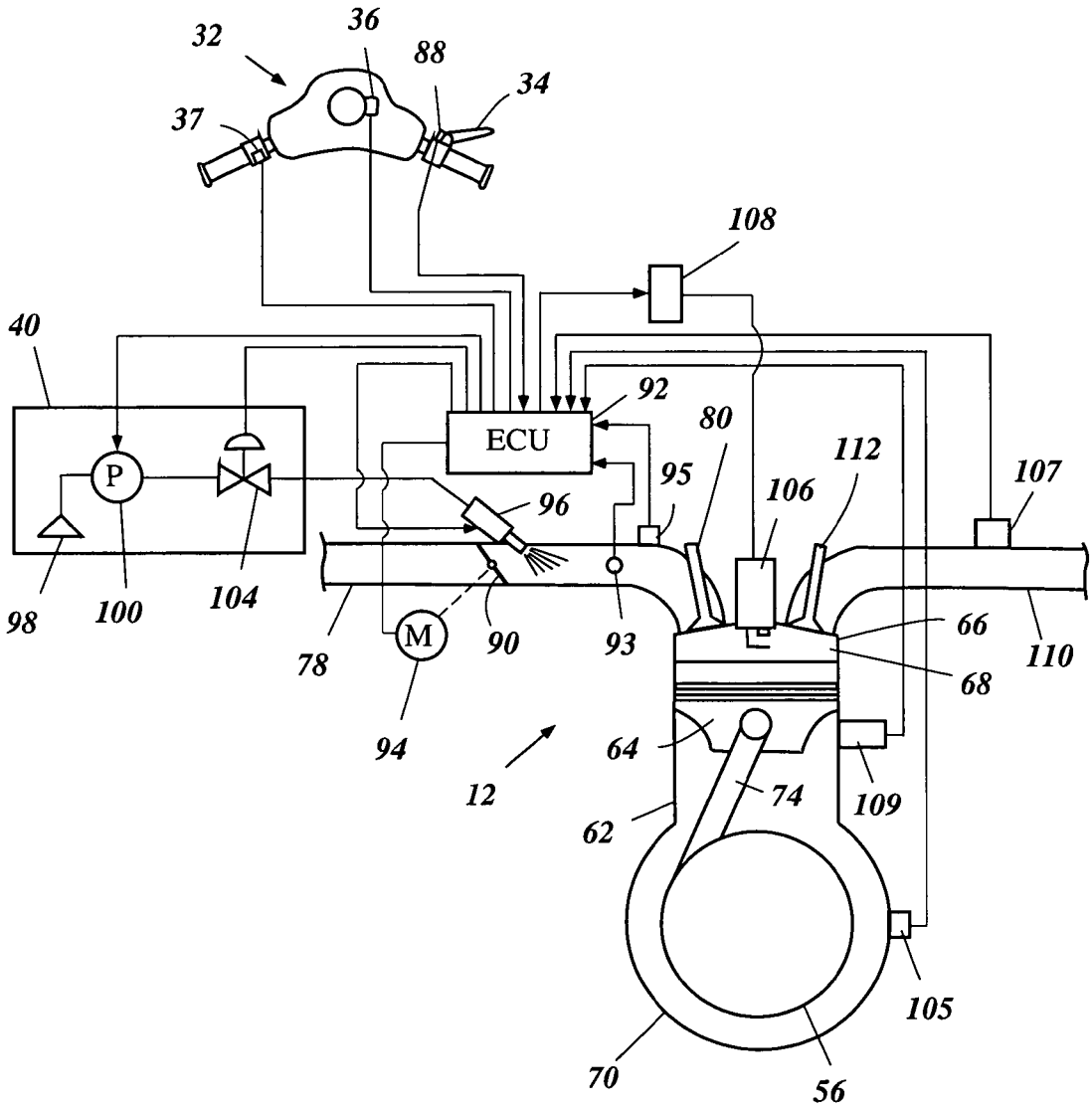
FIG. 3 is a schematic view of the power plant for the personal watercraft of FIG. 1 showing an engine control system including an ECU, a portion of the engine in cross-section, and a simplified fuel injection system, a and simplified steering system.

With reference to FIGS. 1 to 3, an overall configuration of an engine control system, a personal watercraft 10 and its engine 12 is described. The watercraft 10 employs the internal combustion engine 12, which is configured in accordance with a preferred embodiment. The described engine configuration and the associated control routines have particular utility for use with personal watercraft, and thus, are described in the context of a personal watercraft. The engine configuration and the control routine, however, also can be applied to other types of watercraft, such as, for example, small jet boats and other vehicles that rely on jet drives or other similar propulsion systems.

With reference initially to FIG. 1, the personal watercraft 10 includes a hull 14 formed with a lower hull section 16 and an upper hull section or deck 18. The lower hull section 16 and the upper hull section 18 preferably are coupled together to define an internal cavity.

A control mast 26 extends upwardly to support a handlebar 32. The handlebar 32 is provided primarily for controlling in which direction the watercraft 10 travels. The handlebar 32 preferably carries other mechanisms and devices, such as, for example, a throttle lever 34 that is used to control the engine output (i.e., to vary the engine speed). Other types of engine power output request devices can be used instead of a throttle lever, such as, for example, but without limitation, a conventional twist grip or a pivotal handle.

An engine performance switch 37 (FIG. 2) can be used and deployed on or near the handlebar 32 to limit over all engine performance in a reverse mode of operation. The limiting of engine performance using the engine performance switch 37 during the reverse operation mode will be described in detail below. Additionally, other devices can be used to change the performance of the watercraft at least in the reverse direction, such as, for example, a remote transmitter and an on-board receiver or a lanyard key interface that specifies the whether the watercraft can operate at a normal or learner performance level.

The handlebar 32 rotates about a steering shaft 35 that allows the handlebar 32 to rotate left or right within a predetermined steering angle range. A portion of the steering shaft 35 can be mounted relative to the hull 14 with at least one bearing so as to allow the shaft to rotate relative to the hull. The shaft 35 can also be formed in sections that are configured to articulate relative to one another. For example, the shaft sections can be configured for a tilt steering mechanism allowing an angle of inclination of a upper portion of the shaft to be adjustable while a lower section of the shaft 35 remains at a fixed angle of inclination. In some embodiments, the sections can be connected through a universal joint; however, other types of tilt steering mechanisms can also be used.

A steering torque sensor 36 (FIG. 3) can be configured to determine the amount of steering torque applied to the handlebar 32. For example, but without limitation, the steering torque sensor 36 can be configured to detect a magnitude of a force applied to the handlebar 32 when the handlebar 32 is turned past a predetermined handlebar angle. The steering torque sensor 36 can be constructed in any known manner. In one exemplary but non-limiting embodiment, the torque sensor 36 can be configured to work in conjunction with stoppers commonly used on watercraft steering mechanisms to define the maximum turning positions. Such type of steering torque sensor is further described in U.S. Pat. No. 7,166,003 B2, the entire contents of which is hereby incorporated by reference.

A seat 28 is disposed atop a pedestal of the deck 18. In the illustrated arrangement, the seat 28 has a saddle shape. Hence, a rider can sit on the seat 28 in a straddle fashion and thus, the illustrated seat 28 often is referred to as a straddle-type seat.

A fuel tank 40 (schematically identified in FIG. 3) is positioned in the cavity under the bow portion of the upper hull section 18 in the illustrated arrangement. A filler hose (not shown) preferably couples the fuel tank 40 with a fuel inlet port positioned at a surface of the bow of the upper hull section 18. A closure cap closes the fuel inlet port to inhibit water infiltration.

The engine 12 is disposed in an engine compartment. The engine compartment preferably is located under the seat 28, but other locations are also possible (e.g., beneath the control mast 26 or in the bow). The rider thus can access the engine 12 in the illustrated arrangement through an access opening by detaching the seat 28. In general, the engine compartment can be defined by a forward and rearward bulkhead. Other configurations, however, are also possible, e.g., no bulkheads are employed within the hull.

A jet pump unit 46 propels the illustrated watercraft 10. The jet pump unit 46 preferably is disposed within a tunnel formed on the underside of the lower hull section 16. The tunnel has a downward facing inlet port 50 opening toward the body of water. A jet pump housing 52 is disposed within a portion of the tunnel. Preferably, an impeller 53 is supported within the housing 52. Other types of marine drives, however, can be used depending upon the application.

An impeller shaft 54 extends forwardly from the impeller and is coupled with a crankshaft 56 of the engine 12 by a suitable coupling mechanism (not shown). The crankshaft of the engine 12 thus drives the impeller shaft 54. The rear end of the housing 52 defines a discharge nozzle 57. A steering nozzle (not shown) is affixed proximate the discharge nozzle 57. The nozzle can be pivotally moved about a generally vertical steering axis. The steering nozzle is connected to the handle bar 32 by a cable or by other suitable arrangement so that the rider can pivot the nozzle for steering the watercraft.

The watercraft 10 also includes a reverse propulsion device that is selectively operable to propel the watercraft in reverse. In the illustrated embodiment, the watercraft 10 advantageously includes a reverse thrust bucket mechanism 58 that at least partially covers the discharge nozzle 57 when lowered so as to allow at least some of the water discharged from the discharge nozzle 57 to flow towards the front of the watercraft 10. This flow of water towards the front of the watercraft 10 propels the watercraft in the reverse direction. Other types of reverse propulsion devices, including those that discharge water generally forwardly and those the change the rotational directional of the propulsion device, can be employed in other embodiments to propel the watercraft in reverse.

In the illustrated embodiment, a reverse lever 60, which activates the reverse bucket mechanism 58, can be located in the vicinity of the control mast 26. A reverse switch 61 may be positioned between the reverse lever 60 and the reverse bucket mechanism 58 or at other locations to sense when the rider has lowered the reverse bucket mechanism 58. The reverse switch 61 is activated whenever the reverse bucket mechanism 58 is placed in a position that allows the watercraft 10 to travel in the reverse direction. Operation of the watercraft 10 with decreased engine performance in the reverse mode will described below using a control routine. Of course, other types of sensors can be used to determine when the rider operates the watercraft to move reverse.

With reference to FIG. 3, the engine 12 according to one preferred embodiment of the present invention as illustrated in FIG. 3 operates on a four-stroke combustion principle. The illustrated engine 12 includes a cylinder block 62 with four cylinder bores 65 formed side by side along a single plane. The engine 12 is an inclined L4 (in-line four cylinder) type. The engine illustrated in FIG. 3, however, merely exemplifies one type of engine on which various aspects and features of the control system can be used. Engines having a different number of cylinders, other cylinder arrangements, other cylinder orientations (e.g., upright cylinder banks, V-type, and W-type), and operating on other combustion principles (e.g., crankcase compression two-stroke, diesel, and rotary) are all practicable.

With continued reference to FIG. 3, a piston 64 reciprocates in each of the cylinder bores 65 formed within the cylinder block 62. A cylinder head member 66 is affixed to the upper end of the cylinder block 62 to close respective upper ends of the cylinder bores 65. The cylinder head member 66, the cylinder bores 65 and the pistons 64 together define combustion chambers 68.

A lower cylinder block member or crankcase member 70 is affixed to the lower end of the cylinder block 62 to close the respective lower ends of the cylinder bores 65 and to define, in part, a crankshaft chamber. The crankshaft 56 is journaled between the cylinder block 62 and the lower cylinder block member 70. The crankshaft 56 is rotatably connected to the pistons 64 through connecting rods 74. Preferably, a crankshaft speed sensor 105 is disposed proximate the crankshaft to output a signal indicative of engine speed. In some configurations, the crankshaft speed sensor 105 is formed, at least in part, with a flywheel magneto. The engine speed sensor 105 also can output crankshaft position signals in some arrangements. Engine speed and piston position also can be determined by a camshaft sensor.

The cylinder block 62, the cylinder head member 66 and the crankcase member 70 together generally define the engine 12. The engine 12 preferably is made of an aluminum based alloy. In the illustrated embodiment, the engine 12 is oriented in the engine compartment to position the crankshaft 56 generally parallel to a central plane. Other orientations of the engine, of course, are also possible (e.g., with a transversely or vertically oriented crankshaft).

The engine 12 preferably includes an air induction system to introduce air to the combustion chambers 68. In the illustrated embodiment, the air induction system includes four air intake ports 78 defined within the cylinder head member 66, which ports 78 generally correspond to and communicate with the four combustion chambers 68. Other numbers of ports can be used depending upon the application. Intake valves 80 are provided to open and close the intake ports 78 to control flow through the ports 78.

The air induction system also includes an air intake box (not shown) for smoothing intake airflow and acting as an intake silencer. In the present example, the intake box is generally rectangular and defines a plenum chamber (not shown). Other shapes of the intake box of course are possible, but the plenum chamber preferably is as large as possible while still allowing for positioning within the space provided in the engine compartment.

The illustrated air induction system preferably also includes at least one throttle motor 94 that is used to move the position of at least one throttle valve 90. While the present embodiment includes the throttle motor 94 moving only one throttle valve 90, the present control system can be practiced with arrangements where the throttle motor moves a plurality of throttle valves.

The throttle motor 94 illustrated in the preferred embodiment in FIG. 3 is controlled by an Electronic Control Unit (ECU) 92. In one advantageous arrangement, the ECU 92 is a microcomputer that includes a micro-controller having a CPU, a timer, RAM, and ROM. Of course, other suitable configurations of the ECU also can be used. Preferably, the ECU 92 is configured with or capable of accessing various maps, which are stored in on-board or remote memory, to control engine operation in a suitable manner.

The throttle motor 94 is controlled by the ECU 92 according to a throttle lever position sensor 88 and to the particular mode of watercraft operation. For example, in a reverse mode, the ECU 92 controls or limits the throttle position via the throttle motor.

The throttle lever position sensor 88 preferably is arranged proximate the throttle lever 34 in the illustrated arrangement. The sensor 88 generates a signal that is representative of the throttle lever's position. The signal from the throttle lever position sensor 88 preferably corresponds generally to an operator's torque request, as may be indicated by the degree of throttle lever position.

A manifold pressure sensor 93 and a manifold temperature sensor 95 can also be provided to determine engine load. The signal from the throttle lever position sensor 88 (and/or manifold pressure sensor 93) can be sent to the ECU 92 via a throttle position data line. The signal can be used to control various aspects of engine operation, such as, for example, but without limitation, fuel injection amount, fuel injection timing, ignition timing, ISC valve positioning and the like.

The engine 12 also includes a fuel injection system that preferably includes four fuel injectors 96, each having an injection nozzle exposed to a respective intake port 78 so that injected fuel is directed toward the respective combustion chamber 68. Thus, in the illustrated arrangement, the engine 12 features port fuel injection. It is anticipated that various features, aspects and advantages of the present inventions also can be used with direct or other types of indirect fuel injection systems.

With reference again to FIG. 3, fuel is drawn from the fuel tank 40 through a fuel filter 98 by a fuel pump 100, which is controlled by the ECU 92. The fuel is delivered to the fuel injectors 96 through a fuel delivery conduit. The pressure of the fuel delivered to the fuel in sectors 96 is controlled by a pressure control valve 104. The pressure control valve 104 is controlled by a signal from the ECU 92.

In operation, a predetermined amount of fuel is sprayed into the intake ports 78 via the injection nozzles of the fuel injectors 96. The timing and duration of the fuel injection is dictated by the ECU 92 based upon any desired control strategy. In one presently preferred configuration, the amount of fuel injected is determined based, at least in part, upon the sensed throttle lever position. The fuel charge delivered by the fuel injectors 96 then enters the combustion chambers 68 with an air charge when the intake valves 80 open the intake ports 78.

The engine 12 further includes an ignition system. In the illustrated arrangement, four spark plugs 106 are fixed on the cylinder head member 66. The electrodes of the spark plugs 106 are exposed within the respective combustion chambers 68. The spark plugs 106 ignite an air/fuel charge just prior to, or during, each power stroke. At least one ignition coil 108 delivers a high voltage to each spark plug 106. The ignition coil is preferably under the control of the ECU 92 to ignite the air/fuel charge in the combustion chambers 68 at a specific timing.

The engine 12 further includes an exhaust system to discharge burnt charges, i.e., exhaust gases, from the combustion chambers 68. In the illustrated arrangement, the exhaust system includes four exhaust ports 110 that generally correspond to, and communicate with, the combustion chambers 68. The exhaust ports 110 can be defined in the cylinder head member 66. Exhaust valves 112 are provided to selectively open and close the exhaust ports 10.

A combustion condition or oxygen sensor 107 can be provided to detect the in-cylinder combustion conditions by sensing the residual amount of oxygen in the combustion products at a point in time close to when the exhaust port is opened. The signal from the oxygen sensor 107 is delivered to the ECU 92. The oxygen sensor 107 can be disposed within the exhaust system at any suitable location. In the illustrated arrangement, the oxygen sensor 107 is disposed proximate the exhaust port 110 of a single cylinder. Of course, in some arrangements, the oxygen sensor can be positioned in a location further downstream; however, it is believed that more accurate readings result from positioning the oxygen sensor upstream of a merge location that combines the flow of several cylinders.

The engine 12 further includes a cooling system configured to circulate coolant into thermal communication with at least one component within the watercraft 10. The cooling system can be an open-loop type of cooling system that circulates water drawn from the body of water in which the watercraft 10 is operating through thermal communication with heat generating components of the watercraft 10 and the engine 12. Other types of cooling systems can be used in some applications. For instance, in some applications, a closed-loop type liquid cooling system can be used to cool lubricant and other components.

An engine coolant temperature sensor 109 preferably is positioned to sense the temperature of the coolant circulating through the engine. Of course, the sensor 109 could be used to detect the temperature in other regions of the cooling system; however, by sensing the temperature proximate the cylinders of the engine, the temperature of the combustion chamber and the closely positioned portions of the induction system is more accurately reflected.

The engine 12 preferably includes a lubrication system that delivers lubricant oil to engine portions for inhibiting frictional wear of such portions. In the illustrated embodiment of FIG. 4, a dry-sump type lubrication system is employed. An oil delivery pump is provided within a circulation loop to deliver the oil through an oil filter (not shown) to the engine portions that are to be lubricated, for example, but without limitation, the pistons 64 and the crankshaft bearings (not shown).

In order to determine appropriate engine operation control scenarios, the ECU 92 preferably uses these control maps and/or indices stored within the ECU 92 in combination with data collected from various input sensors. The ECU's various input sensors can include, but are not limited to, the throttle lever position sensor 88, the manifold pressure sensor 93, the intake temperature sensor 95, the engine coolant temperature sensor 109, the oxygen ($O_2$) sensor 107, and a crankshaft speed sensor 105. It should be noted that the above-identified sensors merely correspond to some of the sensors that can be used for engine control and it is, of course, practicable to provide other sensors, such as an intake air pressure sensor, an intake air temperature sensor, a knock sensor, a neutral sensor, a watercraft pitch sensor, a shift position sensor, an oil temperature sensor and an atmospheric temperature sensor. The selected sensors can be provided for sensing engine running conditions, ambient conditions or other conditions of the engine 12 or associated watercraft 10.

During engine operation, ambient air enters the internal cavity defined in the hull 14. The air is then introduced into the plenum chamber defined by the intake box and drawn towards the throttle valve 90. The majority of the air in the plenum chamber is supplied to the combustion chambers 68. The throttle valve 90 regulates an amount of the air permitted to pass to the combustion chambers 68. The opening angle of the throttle valve 90, and thus, the airflow across the throttle valve 90, can be controlled by the ECU 92 according to various engine parameters and the torque request signal received from the throttle lever position sensor 88. The air flows into the combustion chambers 68 when the intake valves 80 open. At the same time, the fuel injectors 96 spray fuel into the intake ports 78 under the control of ECU. Air/fuel charges are thus formed and delivered to the combustion chambers 68.

The air/fuel charges are fired by the spark plugs 106 throughout the ignition coil 108 under the control of the ECU 92. The burnt charges, i.e., exhaust gases, are discharged to the body of water surrounding the watercraft 10 through the exhaust system.

The combustion of the air/fuel charges causes the pistons 64 to reciprocate and thus causes the crankshaft 56 to rotate. The crankshaft 56 drives the impeller shaft 54 and the impeller rotates in the hull tunnel 48. Water is thus drawn into the jet pump unit 46 through the inlet port 50 and then is discharged rearward through the discharge nozzle 57.

Figure 4:
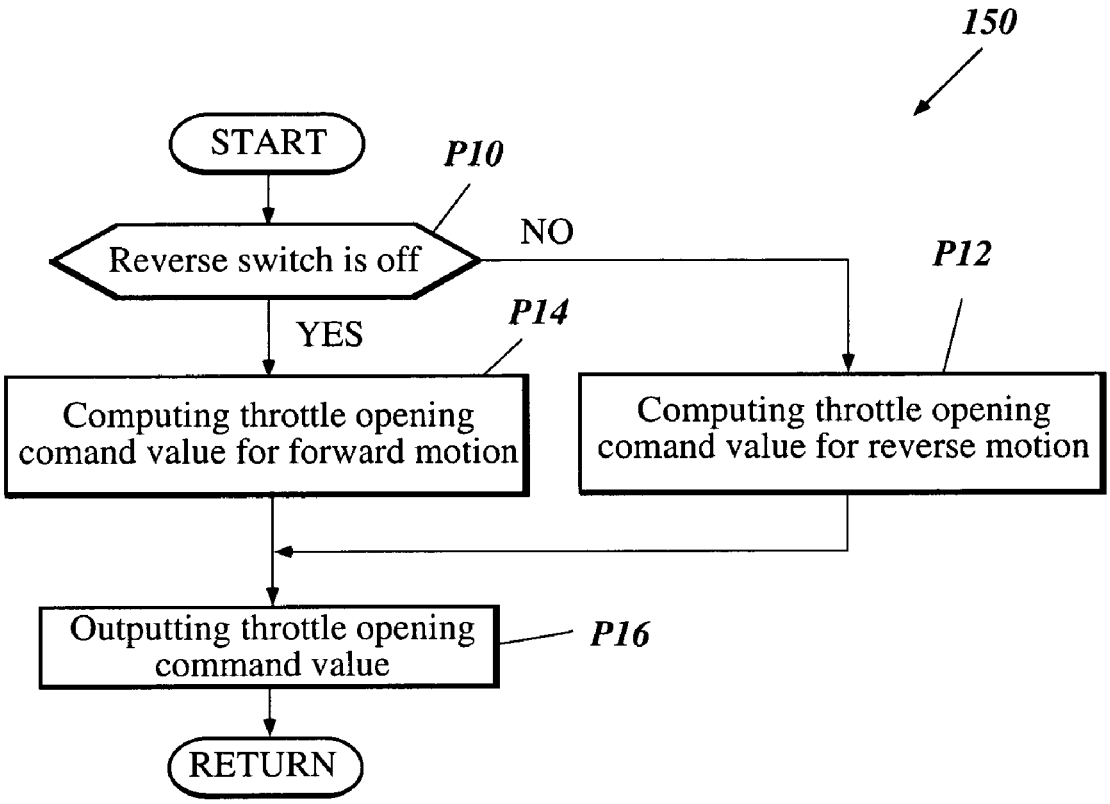
FIG. 4 is a block diagram showing a control routine that can be used with the engine control system of FIG. 3.

With reference to FIG. 4, a control arrangement 150 is shown that is arranged and configured in accordance with an embodiment of the present invention. The control routine 150 illustrates how the ECU 92 can control the watercraft performance during a reverse operation. The control routine 150 begins and moves to a first decision block P10 where it is determined if the reverse switch is off. When the reverse switch is not off, it is indicative of the watercraft being operated in the reverse mode. If in decision block P10 the reverse switch is not off, the control routine 150 proceeds to an operation block P12. If, however, in the decision block P10 it is determined that the reverse switch is off, the control routine proceeds to an operation block P14.

In operation block P12, the ECU 92 calculates the correct throttle position according to the reverse mode of operation. This calculation of the correct throttle position according to the reverse mode will be explained according to FIG. 6 below. The control routine 150 moves to an operation block P16.

In operation block P14, the ECU 92 calculates the correct throttle position according to the forward mode of operation. This calculation of the correct throttle position according to the forward mode of operation will be explained according to FIG. 5 below. The control routine 150 moves to an operation block P16.

In operation block P16, the ECU 92 operates the throttle motor 94 according to whether the watercraft is in either a forward mode of operation or a reverse mode of operation. The ECU 92 operates the throttle motor 94 according to one of two or more control maps (for example, the graphs in FIGS. 5 and 6), depending in which mode watercraft is operating. The control routine 150 then returns.

Figure 5:
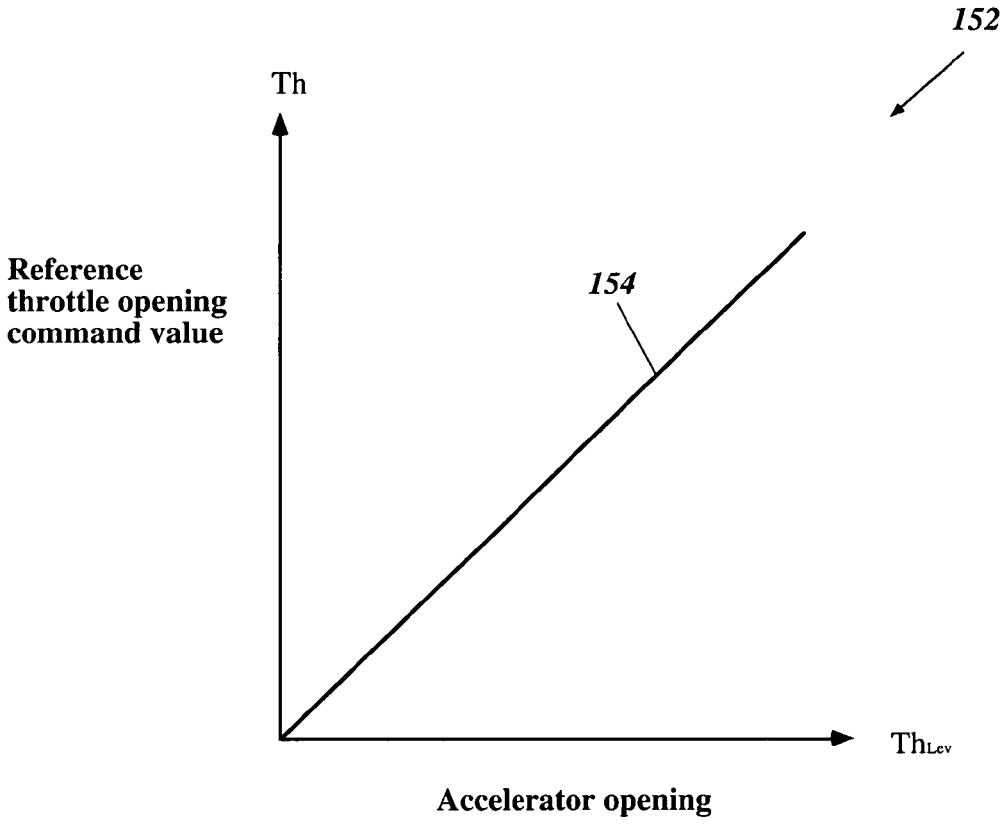
FIG. 5 is a diagram illustrating a two-dimensional graph that shows a normal operation of a motor controlled throttle position with respect to a sensed throttle lever position.

A two dimensional graph 152 in FIG. 5 illustrates a preferred relationship between the actual throttle position Th of the throttle valve 90 and the throttle lever position $Th_{lev}$ indicative of an operators torque request for the forward mode of operation. The relationship between the actual throttle position Th and the throttle lever position $Th_{lev}$ is linear in this example. This linear relationship between Th and $Th_{lev}$ is illustrated by a line 154. Therefore, the relationship between Th and $Th_{lev}$ is the same as if a cable were directly communicating the position of the throttle lever 34 to the throttle 90 instead of the throttle motor 94. For example, if the throttle lever 34 is moved to 50% of its entire possible opening range, the throttle motor 94 will open the throttle valve 90 to 50% of its entire possible opening range. Therefore, when the watercraft 10 is operating in a forward mode, the throttle valve moves in direct response to the torque command from the operator.

Figure 6:
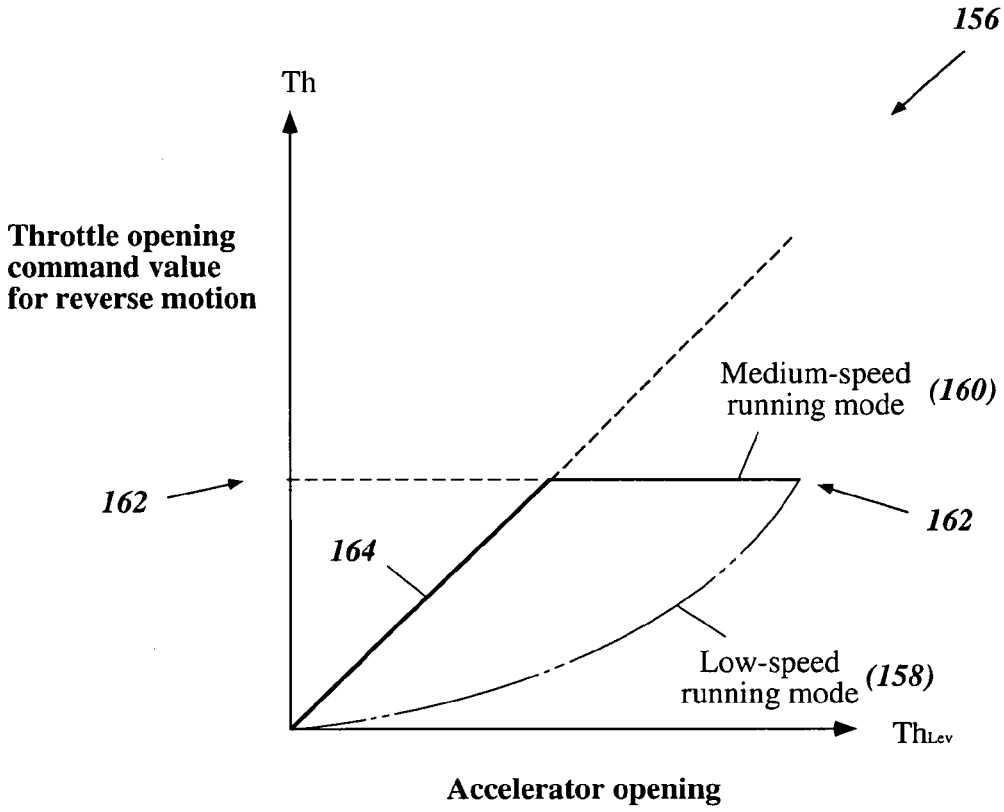
FIG. 6 is another diagram illustrating a two-dimensional graph that shows an operation of a motor controlled throttle position with respect to a sensed throttle lever position when during a medium speed reverse running mode and a low speed reverse running mode.

A two dimensional graph 156 in FIG. 6 illustrates a preferred relationship between the actual throttle position Th of the throttle 90 and the throttle lever position $Th_{lev}$ indicative of an operators torque request. The relationship illustrated in FIG. 6 is for the reverse mode of operation. The engine performance switch 37 can limit engine output in the reverse operation mode according to at least two possible predetermined relationships between the throttle position Th and the throttle lever position $Th_{lev}$.

One of the predetermined relationships is illustrated by a line 158 and is indicative of a low speed running mode. In the low speed running mode when the watercraft is being operated in reverse, the throttle position Th follows the line 158 as the throttle lever position $Th_{lev}$ is increased. For example, the actual throttle position Th increases at a slower rate than the throttle lever position $Th_{lev}$. The actual throttle lever position Th opens at the predetermined slower rate until it reaches a predetermined threshold 162. The threshold 162 is a maximum actual throttle position that effectively limits the performance of the watercraft engine 12. The limiting performance of the engine 12 allows for a slower watercraft operation in the reverse mode.

Another predetermined relationship is illustrated by a line 160 and is indicative of a medium speed running mode. In the medium speed running mode when the watercraft is being operated in reverse, the throttle position Th follows the line 164 as the throttle lever position $Th_{lev}$ is increased. The actual throttle position Th increases linearly with the throttle lever position $Th_{lev}$ until the threshold 162. The threshold 162 is the maximum actual throttle position that effectively limits the performance of the watercraft engine 12. After the threshold 162, the actual throttle position Th continues to follow the line 160. After the threshold 162 the line 160 illustrates how the actual throttle position Th remains at the same position regardless of how the position of the throttle lever is increased.

Other control systems can be used to limit engine performance during the reverse operation. Examples of other control system used to limit engine performance are discussed below. Control of engine performance should not limited to these described control systems in which throttle opening, ignition timing and air/fuel ratio are used independently to control and limit engine speed while in a reverse operations mode. The illustrated systems rather provide a few examples of the many known ways to control engine performance. For example, engine speed can be controlled using the timing of fuel injection, stopping ignition or fuel injection (cylinder disablement) or a combination of two or more of such known approaches, e.g., throttle opening, ignition timing, fuel injection timing, and the amount of fuel injected (i.e., the leanness of the air/fuel charge). Additionally, such engine control approaches can be practiced on less than all of the cylinders and can be practiced by alternate among the cylinders.

Figure 7:
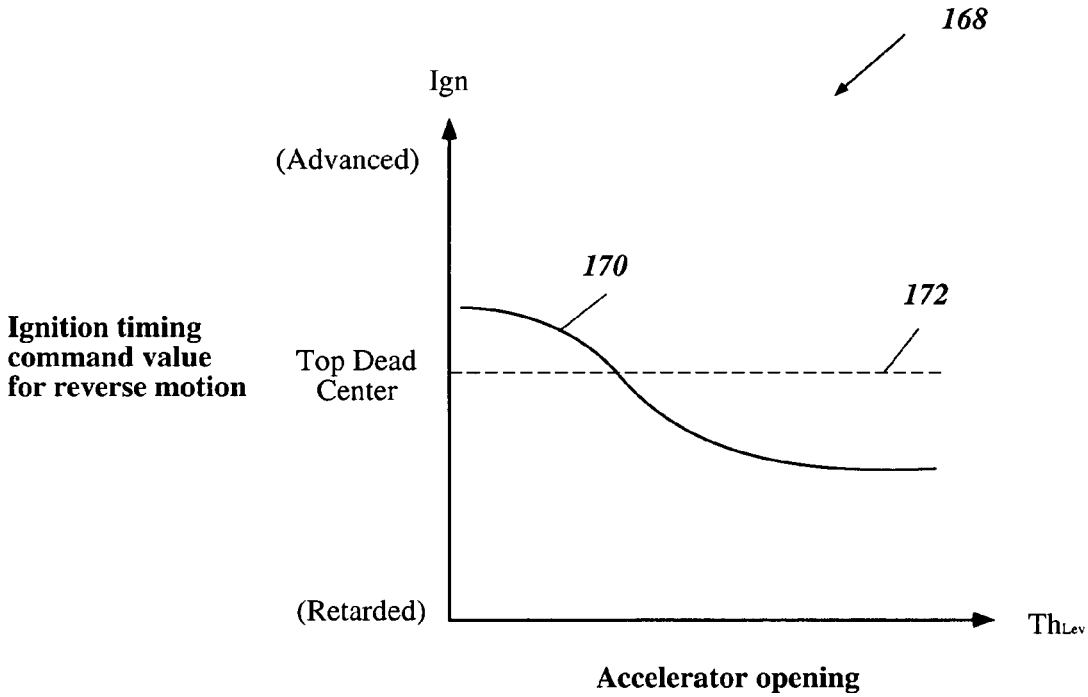
FIG. 7 is a diagram illustrating a two-dimensional graph that shows an ignition timing value range with respect to a sensed throttle lever position.

With reference to FIG. 7, a two dimensional graph 168 is shown that illustrates ignition timing values Ign with respect to the throttle lever position $Th_{lev}$. Adjusting the ignition timing according to the position of the throttle lever represents another preferred way for limiting engine performance during the reverse operation, as mentioned above. Retarded ignition timing lowers engine performance, which consequently slows watercraft speed. When the watercraft 10 is being operated in the reverse mode, the ignition timing value 170 can be retarded with respect to a top dead center position of the piston (reference line 172 in FIG. 7). Therefore, in the reverse mode when an operator has moved the throttle lever position past a predetermined position, the ignition timing will be retarded with reference to top dead center. Retarding the ignition reduces engine performance preventing the watercraft from exceeding a predetermined speed.

Figure 8:
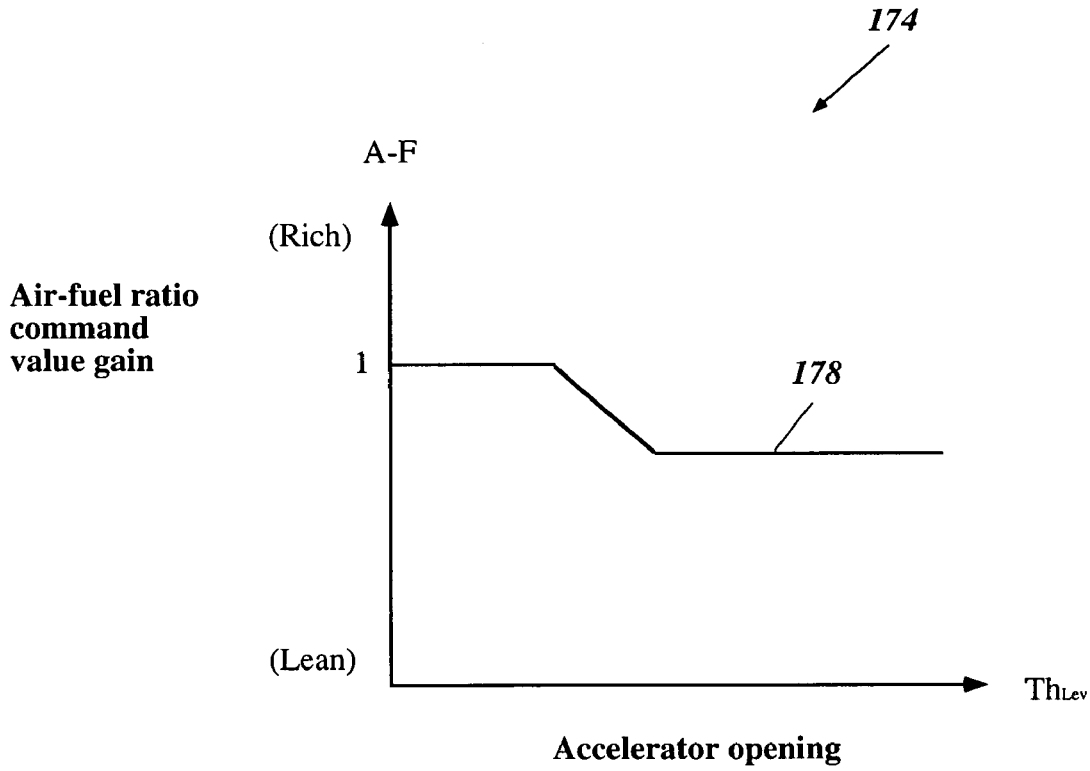
FIG. 8 is a diagram illustrating a two-dimensional graph that shows an air-fuel ratio range with respect to a sensed throttle lever position.

With reference to FIG. 8, a two dimensional graph 174 is shown that illustrates an air-fuel mixture ratio AF with respect to the throttle lever position $Th_{lev}$. Adjusting the air-fuel mixture ratio according to the position of the throttle lever represents another preferred embodiment for limiting engine performance during the reverse operation. An optimal air-fuel ratio for normal engine operation is represented by a number 1. When the air-fuel ratio is raised above the number 1, the mixture becomes rich. When the air-fuel ratio is lowered below the number 1, the mixture becomes lean (i.e. a non-stoichiometric air/fuel ratio). A lean mixture can reduce engine performance, resulting in a lower watercraft speed. The air-fuel ratio can be made lean by decreasing the amount of fuel that is injected or delivered to be combined with the inducted air. For example, a predetermined amount of fuel injected into the engine corresponds to a predetermined air-fuel ratio. If less fuel is injected or delivered to the engine, the mixture will become lean. A predetermined lean mixture can decrease engine performance, which can decrease watercraft speed.

When the watercraft 10 is being operated in the reverse mode, the air-fuel ratio can be made lean, as illustrated by a reference number 178. Therefore, in the reverse mode when an operator has moved the throttle lever position past a predetermined position, the air-fuel ratio can be made lean to reduce engine performance preventing the watercraft from exceeding a predetermined speed.

It is to be noted that the control system described above may be in the form of a hard wired feedback control circuit in some configurations. Alternatively, the control system may be constructed of a dedicated processor and memory for storing a computer program configured to perform the steps described above in the context of the flowchart. Additionally, the control system may be constructed of a general purpose computer having a general purpose processor and memory for storing the computer program for performing the routine. Preferably, however, the control system is incorporated into the ECU 92, in any of the above-mentioned forms.

Although the present invention has been described in terms of certain preferred embodiments, other embodiments apparent to those of ordinary skill in the art also are within the scope of this invention. Thus, various changes and modifications may be made without departing from the spirit and scope of the invention. For instance, various steps within the routine may be combined, separated, or reordered. In addition, some of the indicators sensed (e.g., an engine performance switch, a reverse switch and throttle position) to determine certain operating conditions (e.g., engine performance preference in a reverse mode) can be replaced by other indicators of the same or similar operating conditions. Moreover, not all of the features, aspects and advantages are necessarily required to practice the present invention. Accordingly, the scope of the present invention is intended to be defined only by the claims that follow.

What is claimed is:

1. A method of controlling an engine associated with a watercraft having a reverse propulsion device and an engine power output request device operable by a rider of the watercraft, the method comprising controlling the power output of the engine such that the power output of the engine is proportional to a position of the power output request device in accordance with a first proportional relationship when the watercraft is not operating in reverse, determining whether the rider has operated the reverse propulsion device to propel the watercraft in reverse and controlling the power output of the engine such that the power output of the engine is changed proportionally to changes in the power output request device at all points over a range of movement of the power output request device in accordance with a second proportional relationship between the power output of the engine and the position of the power output request device when the watercraft is operated in reverse such that the power output of the engine is less than that corresponding to a state of the power output request device under the first proportional relationship.

2. The method of claim 1, wherein controlling the power output of the engine further comprises decreasing the engine power output in response to determining that the rider has operated the reverse propulsion device.

3. The method of claim 2, wherein controlling the power output of the engine further comprises limiting the engine power output based upon detection of predetermined engine operational conditions.

4. The method of claim 1, wherein controlling the power output of the engine comprises moving a throttle valve such that air flow into the engine is less than that requested by the engine power output request device.

5. A method of controlling an engine associated with a watercraft having a reverse propulsion device and an engine power output request device operable by a rider of the watercraft, the method comprising determining whether the rider has operated the reverse propulsion device to propel the watercraft in reverse and controlling the power output of the engine such that the power output of the engine, when the watercraft is operating in reverse, is less than that corresponding to a state of the power output request device when the watercraft is not operated in reverse, wherein controlling the power output of the engine comprises retarding ignition timing.

6. A method of controlling an engine associated with a watercraft having a reverse propulsion device and an engine power output request device operable by a rider of the watercraft, the method comprising determining whether the rider has operated the reverse propulsion device to propel the watercraft in reverse and controlling the power output of the engine such that the power output of the engine, when the watercraft is operating in reverse, is less than that corresponding to a state of the power output request device when the watercraft is not operated in reverse, wherein controlling the power output of the engine comprises delivering less fuel to at least one combustion chamber of the engine so as to form a non-stoichiometric air/fuel ratio thereby causing the engine to produce less power.

7. The method of claim 6, wherein the non-stoichiometric air-fuel ratio is a lean air-fuel ratio.

8. A watercraft comprising a hull, a reverse propulsion device selectively operable by a rider of the watercraft to propel the watercraft in reverse, an engine disposed within the hull, an engine power output request device operable by the rider of the watercraft, and a control system including a controller configured to determine whether the rider has operated the reverse propulsion device and to control the power output of the engine such that the power output of the engine is proportional to a state of the power output request device in accordance with a first proportion relationship when the watercraft is not operated in reverse, and to control the power output of the engine such that the power output of the engine is changed proportionally relative to changes in a state of the power output request device over a range of states of the power output request device in accordance with a second proportion relationship when the watercraft is operated in reverse such that the power output of the engine under the second proportional relationship is less than that corresponding to a state of the power output request device under the first proportional relationship.

9. The watercraft of claim 8, wherein the engine further comprises an induction system including at least one throttle valve configured to meter an amount of air moving through the induction system, and the control system includes an actuator configured to control movement of the throttle valve.

10. The watercraft of claim 9, wherein the controller is configured to adjust the actuator to provide a power output from the engine that is less than that corresponding to the state of the power output request device.

11. The watercraft of claim 8, wherein the control system includes a reverse switch to determine when the rider operates the reverse propulsion device, and the reverse switch communicates with the controller.

12. The watercraft of claim 11, wherein the controller is configured to control the power output of the engine in accordance with the state of the power output request device if the determined that the watercraft is not in a reverse operation.

13. A watercraft comprising a hull, a reverse propulsion device operable by a rider of the watercraft, an engine, an engine power output request device also operable by the rider of the watercraft, means for determining a reverse operation of the watercraft and means for controlling the power output of the engine such that the power output of the engine is changed in accordance with a first proportional relationship relative to a position of the power output request device when the watercraft is not operated in reverse, and such that the power output of the engine is changed proportionally relative to all movements of the power output request device when the watercraft is operated in reverse in accordance with a second proportional relationship relative to a position of the power output request device in which the power output of the engine is less under the second proportional relationship than that corresponding to a state of the power output request device under the first proportional relationship.

14. A method of controlling an engine associated with a watercraft having a reverse propulsion device and an engine power output request device operable by a rider of the watercraft, the method comprising controlling the power output of the engine such that the power output of the engine is proportional to a position of the power output request device in accordance with a first proportional relationship when the watercraft is not operating in reverse, determining whether the rider has operated the reverse propulsion device to propel the watercraft in reverse and controlling the power output of the engine in accordance with a second proportional relationship between the power output of the engine and the position of the power output request device when the watercraft is operated in reverse such that the power output of the engine is less than that corresponding to a state of the power output request device under the first proportional relationship, wherein the second relationship defines a smooth and continuous proportional relationship between a position of a throttle valve of the engine over the entire range of movement of the power output request device.

15. A watercraft comprising a hull, a reverse propulsion device selectively operable by a rider of the watercraft to propel the watercraft in reverse, an engine disposed within the hull, an engine power output request device operable by the rider of the watercraft, and a control system including a controller configured to determine whether the rider has operated the reverse propulsion device and to control the power output of the engine such that the power output of the engine is proportional to a state of the power output request device in accordance with a first proportion relationship when the watercraft is not operated in reverse, and to control the power output of the engine such that the power output of the engine is proportional to a state of the power output request device in accordance with a second proportion relationship when the watercraft is operated in reverse such that the power output of the engine under the second proportional relationship is less than that corresponding to a state of the power output request device under the first proportional relationship, wherein the second relationship defines a smooth and continuous proportional relationship between a position of a throttle valve of the engine over the entire range of states of the power output request device.

* * * * *